United States Patent [19]

Hall et al.

[11] 4,152,970

[45] May 8, 1979

[54] FLUID PRESSURE SUPPLY APPARATUS

[75] Inventors: Patrick Hall; Peter F. Walker, both of Witney, England

[73] Assignee: Smiths Industries Limited, London, England

[21] Appl. No.: 703,384

[22] Filed: Jul. 7, 1976

[30] Foreign Application Priority Data

Jul. 7, 1975 [GB] United Kingdom ..... 28550/75

[51] Int. Cl.[2] ..... F01L 25/04; F15B 13/04

[52] U.S. Cl. ..... 91/318; 91/404; 91/436; 91/449

[58] Field of Search ..... 91/436, 318, 404, 449, 91/356, 392, 407

[56] References Cited

U.S. PATENT DOCUMENTS

| | | | |
|---|---|---|---|
| 1,913,663 | 6/1933 | Ferris | 91/436 X |
| 2,267,284 | 12/1941 | Livers | 91/436 |
| 2,502,547 | 4/1950 | Adams et al. | 91/436 X |
| 2,770,222 | 11/1956 | Anderson | 91/356 |
| 2,800,110 | 7/1957 | Haarmeyer | 91/436 X |
| 3,071,926 | 1/1963 | Olson et al. | 91/436 X |
| 3,358,563 | 12/1967 | Williams | 91/318 X |
| 3,633,461 | 1/1972 | Taki et al. | 91/436 |
| 3,759,144 | 9/1973 | Ikeda | 91/436 |
| 3,795,177 | 3/1974 | Cryder | 91/436 X |

FOREIGN PATENT DOCUMENTS

| | | | |
|---|---|---|---|
| 212519 | 2/1958 | Australia | 91/436 |

*Primary Examiner*—Irwin C. Cohen

*Attorney, Agent, or Firm*—Pollock, Vande Sande & Priddy

[57] ABSTRACT

A fluid pressure supply apparatus includes a fluid pressure source, a fluid supply circuit to receive fluid under pressure from the fluid pressure source, and a fluid return circuit. These circuits are to be coupled to an hydraulic motor through first and second fluid paths. The supply apparatus further includes first means to couple the fluid supply circuit to the first fluid path to cause the hydraulic motor to be operated by the fluid pressure in a predetermined sense, and second means simultaneously to couple the second fluid path either to the fluid supply circuit, to provide a regenerative coupling for the motor, or to a fluid return path. This latter coupling is initially to the second fluid path, the second means being arranged to transfer that coupling from the fluid supply circuit to the fluid return path during operation of the motor in the predetermined sense.

4 Claims, 1 Drawing Figure

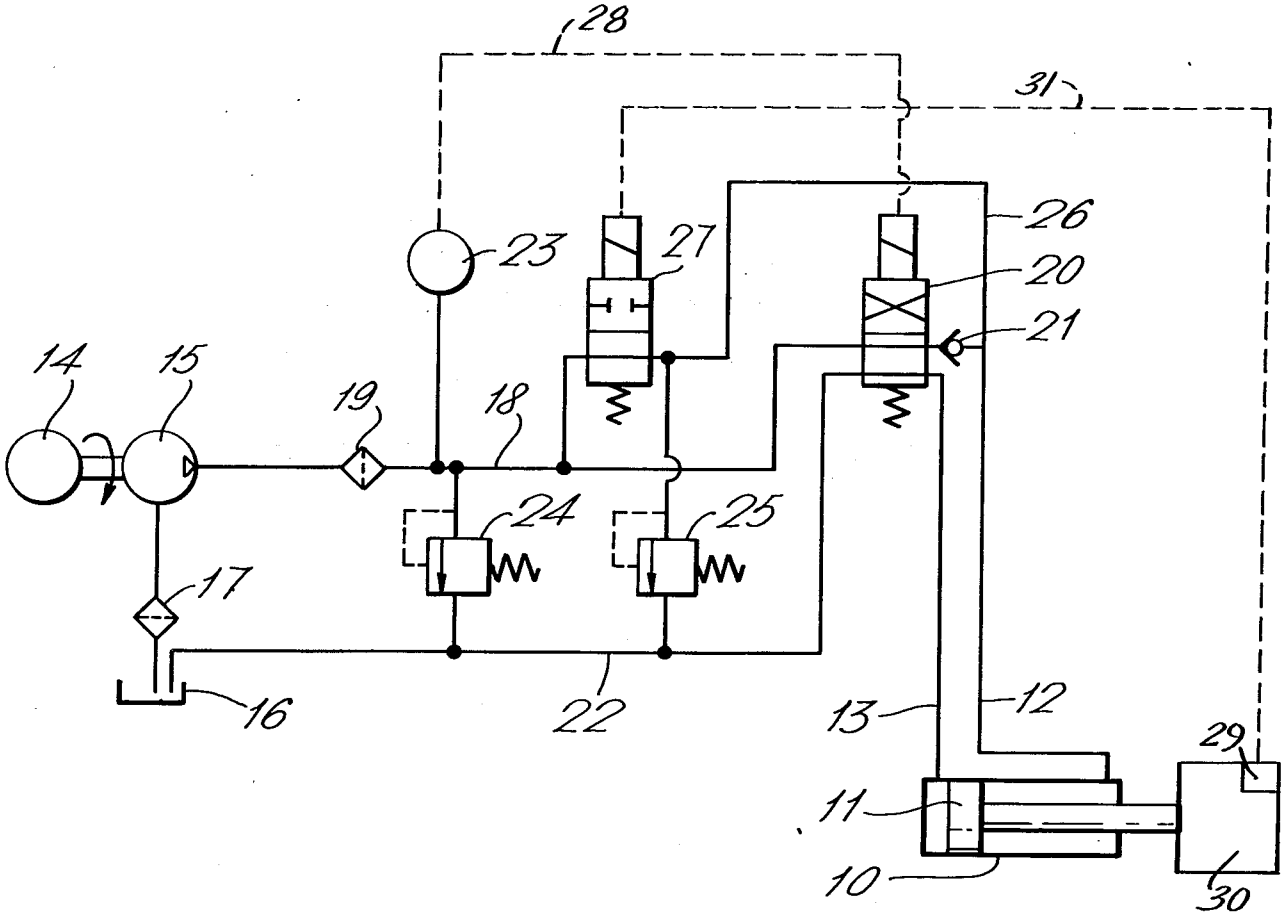
10
11
12
13
14
15
16
17
18
19
20
21
22
23
24
25
26
27
28
29
30
31

FLUID PRESSURE SUPPLY APPARATUS

This invention relates to fluid pressure supply apparatus.

According to the present invention there is provided fluid pressure supply apparatus comprising a fluid pressure source, a fluid supply circuit to receive fluid under pressure from the fluid pressure source, and a fluid return circuit, which circuits are to be coupled to an hydraulic motor through first and second fluid paths, first means to couple the fluid supply circuit to the first fluid path to cause the hydraulic motor to be operated by the fluid pressure in a predetermined sense, and second means simultaneously to couple the second fluid path either to the fluid supply circuit, to provide a regenerative coupling for the motor, or to a fluid return path, the second means being arranged to transfer the coupling of the second fluid path from the fluid supply means to the fluid return path during operation of the motor in the said predetermined sense.

The said fluid return path may be coupled to the said fluid return circuit.

The said second means may be arranged to effect said coupling transfer in response to operation of the motor.

The said second means may comprise a first valve to couple the said second fluid path to the fluid supply circuit and a second valve to couple the said second fluid path to the said fluid return path. In these circumstances, the first valve may be an electrically-operated valve responsive to operation of the motor, and the second valve may comprise a pressure-responsive valve that is operable to couple the second fluid path to the fluid return path whenever the pressure in the second fluid path attains a predetermined value.

The fluid pressure supply apparatus may include a further pressure-responsive valve which is arranged to couple the fluid supply circuit to the fluid return circuit whenever the pressure in the fluid supply circuit attains a predetermined value greater than the predetermined value of the first-mentioned pressure-responsive value.

The said first means may comprise a two-state change-over valve operable in accordance with the pressure in the fluid supply circuit to couple the fluid supply circuit to the first fluid path when in one state, and to couple the fluid supply circuit and the fluid return circuit to, respectively, the second and first supply paths when in the other state. In such a case, the changeover valve may be arranged to adopt the said other state only after the pressure in the fluid supply circuit has attained a predetermined value intermediate the aforementioned predetermined pressure values.

Fluid pressure supply apparatus in accordance with the present invention for supplying pressurised hydraulic fluid will now be described, by way of example, with reference to the accompanying drawing which shows the hydraulic circuit of the apparatus.

It has been common practice in connecting, for example, two telephone cables that each contain a large number (for example, up to 9600) of individually insulated wires, manually to join together corresponding wires from each cable. This practice, being achieved manually, is extremely time consuming. Accordingly, equipment, comprising a jointing head and power supply apparatus has been proposed that will automatically crimp together in a connecting tag the corresponding pairs of wires fed to the jointing head. The jointing head comprises a pair of opposed crimping jaws that close and open upon the reciprocating linear movement of an operating ram. This ram is linearly reciprocated by a piston slidable within a closed cylinder whose opposite ends are alternatively connected to a source of hydraulic fluid under pressure via respective fluid supply conduits. The cylinder and piston are shown schematically in the drawing at 10 and 11 respectively with the cylinder 10 being coupled to the exemplary fluid pressure supply apparatus by fluid paths 12 and 13.

The fluid pressure supply apparatus shown in the drawing includes an electric motor 14 coupled to an electric storage battery (not shown) to drive an hydraulic pump 15. This pump 15 receives hydraulic fluid from a reservoir 16 through a filter 17 and supplies this fluid under pressure to a feed line 18, constituting a fluid supply circuit, through a filter 19. As shown, the feed line 18 communicates via a solenoid-operated changeover valve 20 and a check valve 21 with the fluid path 12, the fluid path 13 communicating through the changeover valve 20 with a return line 22, constituting a fluid return circuit, leading to the reservoir 16. A pressure switch 23 connected to the feed line 18 is arranged to supply an electrical signal via a lead 28 to the solenoid of the changeover valve 20 until the feed line pressure has reached a predetermined pressure value. While the changeover valve 20 is being actuated in response to the electrical signal the changeover valve is in the opposite state to that shown in the drawing, that is, with the feed line 18 coupled to the fluid path 13 and the return line 22 coupled to the check valve 21.

An electrical resistance of pre-selected or calibrated value is electrically connected in parallel with the winding of the changeover valve's solenoid so that a predetermined time delay occurs between the cessation of the electrical signal from the pressure switch 23 and completion of the changeover action of the changeover valve 20. By providing such a predetermined time delay (contrary to the present day tendency to minimize the response time with a view to obtaining immediate response), the pressure of the hydraulic fluid fed to the piston 11 is maintained for a predetermined period of time corresponding to the time delay. This maintained pressure is at least the predetermined pressure value at which the pressure switch 23 operates. In a particular instance the predetermined time delay was sufficient for a rising pressure in the feed line 18 to continue to rise beyond the predetermined operating pressure of the pressure switch 23, and maintain pressure on the piston 11 for a period of several tens of milliseconds. This period is accurately controllable by selecting the value of the electrical resistance controlling the response time delay of the winding of the solenoid-operated changeover valve 20.

It will be appreciated that it is desirable for a particular fluid pressure to be maintained for at least a predetermined time period, since the connecting tag to be crimped is somewhat resilient and, if the crimping pressure was applied to the tag for a shorter period, an inadequate connection might result due to the tag opening slightly under its inherent resilience. Furthermore, the particular fluid pressure must lie within fairly narrow limits or else the crimping pressure might be so high as to result in damage to the wires being connected or to the connecting tags.

To this end, the apparatus is provided with a primary pressure relief valve 24 and a secondary pressure relief valve 25. The primary pressure relief valve 24 is connected between the feed and return lines 18 and 22, and is arranged to open and provide communication between these lines when the feed line pressure is at a predetermined value slightly greater than the predetermined operating pressure of the pressure switch 23. The secondary pressure relief valve 25, which forms part of a network for regenerativley coupling the fluid paths 12 and 13, is arranged to permit fluid flow through that valve 25 when the pressure applied thereto attains a predetermined value which is substantially less than the predetermined pressure at which the switch 23 operates. The secondary relief valve 25 is coupled at one end to the return line 22, through a fluid conduit constituting a fluid return path, and at its other end to a line 26 coupled to the fluid path 12. This line 26 is also coupled, at its end remote from the fluid path 12 to the feed line 18 through a solenoid-operated on-off valve 27. This on-off valve 27 is normally open, to permit fluid flow therethrough, and adopts such state whenever no electric signal is applied to its solenoid.

In these circumstances, with the on-off valve 27 open and the feed line 18 connected to the fluid path 13, there is a regenerative coupling between the fluid paths 12 and 13 with the fluid in the fluid path 12 flowing through the line 26 and the on-off valve 27 to the feed line 18.

An electric switch 29 disposed within the jointing head of the equipment (shown at 30) ensures that no electric signal is applied to the solenoid of the on-off valve 27 until the crimping jaws of the equipment have moved through a predetermined distance. This electric signal is supplied to the solenoid of the on-off valve 27 via a lead 31.

If dirt or unwanted wire insulation from a previous connection remains within the crimping jaws, the obstruction provided by this foreign or unwanted matter might result in inadequate electrical connection being provided. Accordingly if such an obstruction provides a sufficient resistance to closure of the crimping jaws, the predetermined distance for switch actuation will not be traversed and the electric switch 29 will not be actuated. In these circumstances the secondary pressure relief valve 25 prevents the fluid pressure in the regenerative circuit exceeding the operating pressure of the relief valve 25.

If no obstruction to closure of the crimping jaws exists, the said predetermined distance is soon traversed and the electric switch actuated, preferably by the operating ram of the equipment. An electric signal is thus applied to the solenoid of the on-off valve 27 via the lead 31 to close that valve. At this time the fluid pressure in the line 26 is sufficient to operate the secondary pressure relief valve 25 and the fluid in the line 26 flows to the return line 22 through this valve.

Thereafter, the pressure cannot exceed the high predetermined pressure limit provided by the primary relief valve 24.

The check valve 21 serves to inhibit fluid flow directly from the fluid path 12 to the return line 22.

In operation, a pair of wires to be connected (one from each cable) is inserted into the jointing head which is automatically fed with connecting tags from a cassette. The motor 14 is switched on manually and the pump 15 supplies hydraulic fluid to the piston 11 via the feed line 18, the changeover valve 20 and the fluid path 13, and the piston 11 is moved along the housing 10 (to the right in the drawing) under the control of the regenerative circuit with the fluid pressure in the circuit being limited to the operating pressure of the secondary pressure relief valve 25. If there is no obstruction to closure of the head's crimping jaws, the on-off valve 27 is closed upon initial closure of these jaws to prevent further fluid flow back to the feed line 18, the pressure in the feed line 18 then rising rapidly until the pressure switch 23 is actuated at its predetermined operating pressure. This pressure is then maintained as previously described for a period of time to ensure proper crimping of a tag connector about the two associated wires. Changeover of the valve 20 is effected, in response to cessation of the electric signal from the pressure switch 23, to the position shown in the drawing to cause the pressurised fluid in the feed line 18 to act on the opposite side of the piston 11 and return it to its original position and thereby permit opening of the crimping jaws and removal of the connected pair of wires. When the piston 2 returns to its original position, a further electric switch is automatically operated to de-energise the motor 14.

It is visualised that when the change-over valve 20 is in the opposite state to that shown in the drawing, the valve 20 may be arranged to connect only the feed line 18 to the fluid path 13 and to provide no connection between the return line 22 and the check valve 21. In these circumstances the check valve 21 may be omitted.

We claim:

1. Hydraulic apparatus comprising:

a hydraulic motor and fluid pressure supply apparatus to control the operation of the hydraulic motor, the fluid pressure supply apparatus comprising a fluid pressure source, a fluid supply circuit to receive pressurized fluid from the fluid pressure source, and a fluid return circuit;

electrical means responsive to operation of said hydraulic motor to derive an electrical signal which is indicative of whether the hydraulic motor has attained a predetermined position;

first and second fluid paths to couple the fluid supply circuit and the fluid return circuit to the hydraulic motor;

a fluid return path;

first means for coupling the fluid supply circuit to the first fluid path to cause the hydraulic motor to be operated by the pressurized fluid in a predetermined sense;

and second means simultaneously to couple the second fluid path selectively and alternatively to the fluid supply circuit to provide a regenerative coupling for the hydraulic motor or to said fluid return path;

said second means comprising a first valve coupling said second fluid path to the fluid supply circuit and responsive to said electrical signal to disconnect said second fluid path from the fluid supply circuit when the hydraulic motor reaches said predetermined position and a pressure-responsive second valve coupled between the second fluid path and said fluid return path and operable during operation of the motor in said predetermined sense to transfer coupling of the second fluid path to said fluid return path whenever the pressure in the second fluid path attains a predetermined value.

2. Hydraulic apparatus according to claim 1, wherein the said fluid return path is coupled to the said fluid return circuit.

3. Hydraulic apparatus according to claim 1, including a further pressure-responsive valve to couple the fluid supply circuit to the fluid return circuit, which valve includes means for effecting its said coupling whenever the pressure in the fluid supply circuit attains a predetermined value greater than the predetermined value of the first-mentioned pressure-responsive valve.

4. Hydraulic means according to claim 1, wherein the said first means comprises a two-state changeover valve including means responsive to the pressure in the fluid supply circuit to couple the fluid supply circuit to the first path when in one state, and to couple the fluid supply circuit and the fluid return circuit to, respectively, the second and first supply paths when in its other state.

* * * * *